US005152422A

United States Patent [19]

Springer

[11] Patent Number: 5,152,422

[45] Date of Patent: Oct. 6, 1992

[54] MEDICATION DISPENSER

[76] Inventor: Reinhold A. Springer, 395 S. Dexter, Deland, Fla. 32720

[21] Appl. No.: 628,145

[22] Filed: Dec. 17, 1990

[51] Int. Cl.[5] ..... B65B 59/00

[52] U.S. Cl. ..... 221/2; 221/3; 221/15; 221/113; 221/121; 221/133

[58] Field of Search ..... 221/2, 3, 9, 13, 15, 221/112, 113, 119, 120, 121, 122, 123, 133, 191, 151, 197, 287, 281

[56] References Cited

U.S. PATENT DOCUMENTS

| | | | |
|---|---|---|---|
| 1,644,371 | 10/1927 | Goldman | 221/121 X |
| 1,723,497 | 8/1929 | Zucchelli | 221/113 |
| 1,987,914 | 1/1935 | Smith | 221/113 |
| 4,573,606 | 3/1986 | Lewis et al. | 221/2 |
| 4,674,651 | 6/1987 | Scidmore et al. | 221/3 |
| 4,838,453 | 6/1989 | Luckstead | 221/2 |
| 4,872,591 | 10/1989 | Konopka | 221/3 |

*Primary Examiner*—David H. Bollinger
*Attorney, Agent, or Firm*—William M. Hobby, III

[57] ABSTRACT

A dispenser for dispensing predetermined pills in sequential order has a base with a cylindrical housing removably mounted on the base and has a pill container dispenser opening in the cylindrical housing. A pill container magazine is rotatably mounted inside the cylindrical housing and has a plurality of magazine sections thereon for holding a plurality of vertically stacked pill containers in stacked arrays. The pill container magazine in a manual embodiment has a plurality of shift knobs thereon for rotatably shifting the pill container magazine within the cylindrical housing between dispensing positions. A visual and audible signal system is mounted in the dispenser base and is actuated by a timer or clock mechanism to signal the time for a patient to take the pills in one pill container in the pill container magazine. A motorized unit has a standard commercial timer mounted beneath the rotatable magazine and has a mechanism for shifting the magazine between positions as the timer mechanism rotates to thereby automatically rotate and align the magazine with the appropriate pill container and set off the visual and audio alarm reminder.

12 Claims, 2 Drawing Sheets

MEDICATION DISPENSER

BACKGROUND OF THE INVENTION

The present invention relates to a pill dispenser and especially to a pill dispenser for dispensing predetermined pills in pill containers in sequential order and signaling the patient of the appropriate time for taking the next dosage of medicine.

Frequently, when an individual is taking medication he or she must take the medication at spaced intervals over some extended period of time. Typical of such users are the chronically ill who take medication to control their illness and ease their pain, women who take birth control pills, and the elderly who must take dietary or hormonal supplements. Many of these users continue to use single compartment pill containers of the type which are typically provided by a druggist and in which no provision is made for the orderly dispensing of the medication on a schedule over an extended period. Other users, because they must take a variety of medications, prefer segmented containers, such as the type found in U.S. Pat. No. 1,896,976, which segregates the different types of medication but is not adapted to hold the medication in an ordered arrangement to be sequentially dispensed in accordance with a preset medication schedule. If the individual must take more than one kind of medication or if the dosage level or type of medication prescribed varies according to the time it should be taken, or if the spaced intervals between administration of the medication are somewhat irregular, the individual may have difficulty in remembering and determining which medication to take at what time, and may even, on occasion, forget to take the medication required and thereafter be unable to ascertain which, or even whether, any medication has been missed.

A number of attempts have been made to develop dispensers for use in sequentially dispensing medicaments in pill or tablet form that will conveniently allow the user to quickly determine when the last pill or tablet was dispensed and when the next pill or tablet should be taken. All, including such devices as are found in U.S. Pat. Nos. 3,921,806, 3,261,455, and 2,953,242, have suffered from various shortcomings, such as requiring a large number of separate pill compartments thereby increasing the surface area of the container and thus making the container inconvenient to store; requiring intricate and cumbersome means of accessing and dispensing a compartmented pill or tablet and thereby increasing the complexity of the device and requiring added parts or requiring elaborate means to move the pills or tablets around in the container thereby increasing the likelihood that the pills will be broken and damaging the pills and jamming the pill movement system. Failing to sequentially order pills within a compartment may result in an inability to ensure that a single, proper pill will be dispensed therefrom when the compartment is next accessed or failing to provide a user recognizable pill-time correspondence may thereby result in an inability of the user to easily determine if or when a pill was last taken. Failing to provide any way in which the user can quickly and easily refill the dispenser for reuse may result in uneconomical one time usage by an individual with the attendant increased cost thereof. Most of the known pill dispensers suffer one or more of these disadvantages. The present invention overcomes these and other disadvantages and at the same time allows the user to quickly determine when the last pill or tablet was dispensed, when the next pill or tablet should be taken, and which of the pills in the container should next be dispensed, and it does so by a container having fewer parts, less complexity, and at a lower cost.

Prior art pill dispensers of this type may be seen in the Rossmo U.S. Pat. Nos. 4,083,452 and 4,334,617, each of which has containers for medication along with a locking device for rotating the dispensing position from a day-to-day position for dispensing pills and having an interlock so that each day's pills are dispensed as the device is rotated. In the Carlson U.S. Pat. No. 4,223,801, an automatic periodic drug dispensing system operates in connection with a timing circuit for alerting patient's when medication and specific drugs are to be taken. In the Rappaport et al. U.S. Pat. No. 4,807,757, a pill dispenser dispenses on a day-to-day basis from a magazine of stacked arrays of medication by day and week which releases the medication through a funnel shaped end portion. The Sunnen U.S. Pat. No. 4,127,190 shows a dispenser for dispensing pills or tablets in a predetermined order in which a stacked array is marked by day and which can be rotated from day to day for dispensing individual medications. The Robbins U.S. Pat. No. 3,678,884 is a dispensing and recording container rotated on a day-to-day basis.

SUMMARY OF THE INVENTION

A dispenser for dispensing predetermined pills in sequential order has a base with a cylindrical housing removably mounted on the base and has a pill container dispenser opening in the cylindrical housing. A pill container magazine is rotatably mounted inside the cylindrical housing and has a plurality of magazine sections thereon for holding a plurality of vertically stacked pill containers in stacked arrays. The pill container magazine in a manual embodiment has a plurality of shift knobs thereon for rotatably shifting the pill container magazine within the cylindrical housing between dispensing positions. A visual and audible signal system is mounted in the dispenser base and is actuated by a timer or clock mechanism to signal the time for a patient to take the pills in one pill container in the pill container magazine. A signal switch turns the visual and audio signals off. A dispensing lever allows the pushing of one lever to push a pill container from the magazine through a dispenser opening in the housing. The rotatable magazine is shifted to its next position by shifting one of the shift knobs on the magazine a predetermined distance in an arcuate slot. The arcuate slot allows the grasping of the shifting knob and sliding the length of the slot to thereby align the next days pill containers with a cylindrical housing dispenser opening. This allows the pill dispenser to signal a patient at the appropriate time for taking a pill and allows the shifting of the pill container magazine to the correct dispensing position for the pill container to be dispensed and thereby assist a patient in taking the correct dosage in the correct time sequence. A motorized unit has a standard commercial timer mounted beneath the rotatable magazine and has a mechanism for shifting the magazine between positions as the timer mechanism rotates to thereby automatically rotate and align the magazine with the appropriate pill container and set off the visual and audio alarm to take the next set of pills.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 2:
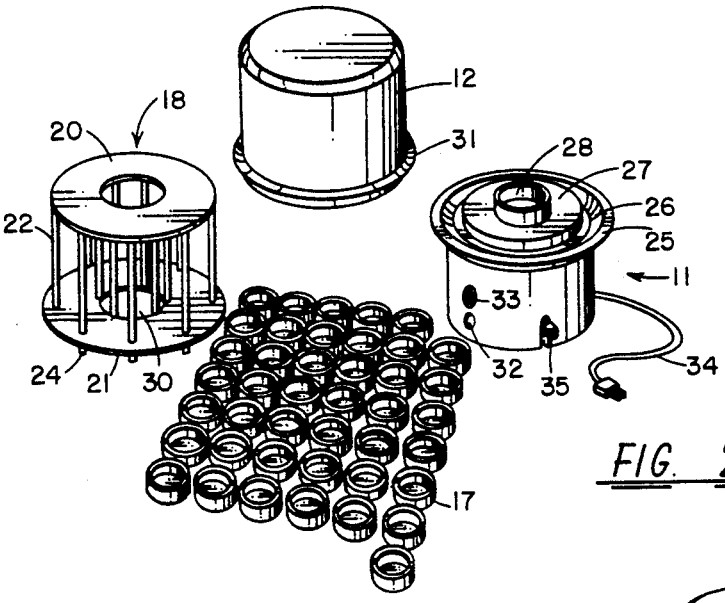
FIG. 2 is an exploded view of the disassembled components of the pill dispenser of FIG. 1.
Figure 4:
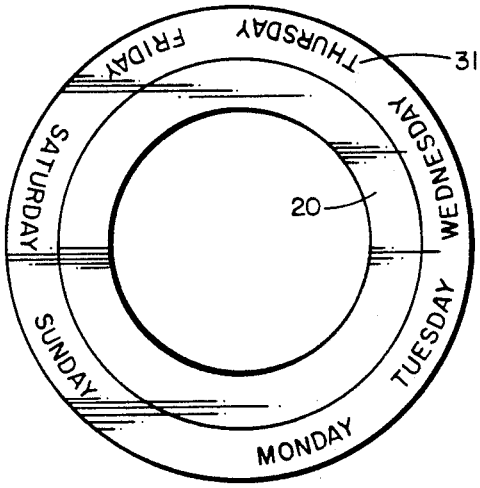
FIG. 4 is a top elevation of the magazine of the pill dispenser of FIGS. 1-3.
Figure 1:
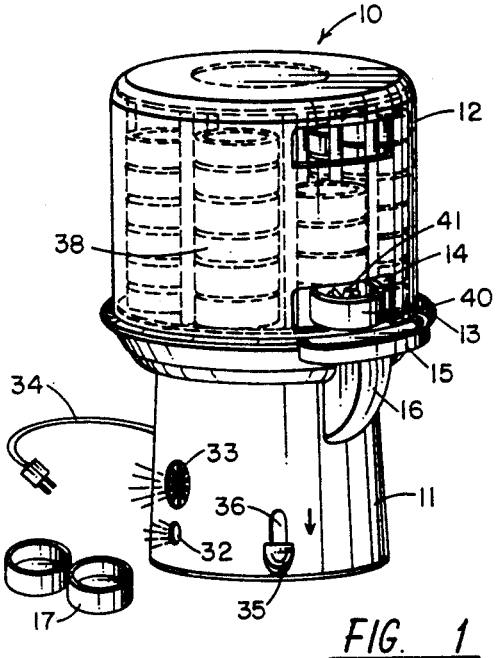
FIG. 1 is a perspective view of a pill dispenser in accordance with the present invention.

Referring to FIGS. 1-5, a pill dispenser 10 is illustrated in FIG. 1 for dispensing predetermined pills in sequential order. The pill dispenser has a base portion 11 and a cylindrical removable housing 12 which fits on the base 11. The housing 12 sits in a arcuate flange portion 13 on the base 11 and has a pill dispensing opening 14 therethrough which dispenses onto a table portion 15 supported by a support bracket 16 formed on the base 11. The removable housing 12 is transparent so that a plurality of pill dispensing containers 17 are visible in stacked arrays through the cover 12 so that markings on the pill containers can be seen through the transparent housing 12. A rotatable pill container magazine 18 has a top plate 20 and a bottom plate 21 spaced by a plurality of dowels 22 with the spacing being specifically aligned for the pill container 17 to be supported therebetween in stacked arrays. A plurality of shifting knobs 24 are mounted below the bottom plate 21 of the magazine 18 and can be a continuation of the dowels 22 if desired but have rounded ends to form knobs and are spaced at a predetermined spacing for shifting the rotatable magazine 18 a predetermined distance for aligning each next stacked array of pill containers in the magazine 18 with the opening 14 in the transparent cylindrical cover 12. The magazine 18 is placed within the disc flange portion 25 and is spaced by a ledge 26 and can rotate on the disc flange portion 25 kept in position by the ledge 26 of a raised portion 27 and by center cylindrical sleeve 28 placed in the middle which allows the cylindrical opening 30 to ride therearound while the knobs 24 ride on the surface of the disc flange portion 25 around the raised ledge 26 with the cylindrical housing 12 placed thereover and held in place by protruding flange 31 having the opening 14 therein aligned with the dispensing surface 15 of the base 11. Each arrayed stack of pill containers 17 placed in the magazine 18 would represent typically one day of the week for any number of weeks so that the magazine 18 might have weekdays 31 spaced across the top along each magazine vertical pill array position which can assure the user that the appropriate day is aligned with the opening 14 for dispensing pills for that day. Each pill container can also have indicia thereon to indicate contents or other information and which can be seen through the transparent housing 12. The base 11 also has a light signal 32 and a sound transducer 33 for signaling to a patient the exact time for taking the patient's medicine which has also been placed in the pill container 17 in the exact dosage required for that day in that position within the magazine 18. The signals 32 and 33 are activated by a standard 24-hour clock timer of conventional design which activates an alarm at predetermined cycles within a 24-hour cycle. The signals 32 and 33 and the driving alarm clock or timer mechanism has a power cord 34 for powering the clock timer and the signals. Once the signal lights 32 and/or buzzer 33 are activated, they stay for thirty minutes on until they are shut off. Depressing lever 35 pushes the pill container 40 from the magazine 18 through the opening 14 in the housing. The magazine 18 can then be shifted to the next position for dispensing the next days pills. The magazine is shifted by a single knob 24 extending through an arcuate slot 37 in the base 11 saucer shaped flange 25.

Figure 3:
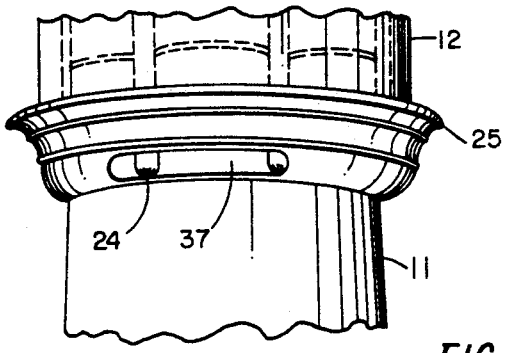
FIG. 3 is a partial elevation of the pill dispenser of FIG. 1 illustrating the shift knobs for shifting the magazine between sequential positions.

As shown in FIG. 3, the slot 37 is of a predetermined length so that sliding the knob 24 in FIG. 3 the length of the slot exactly shifts the magazine 18 to align the next stacked array 38 of pill containers with the bottom pill container aligned with the opening 14 for dispensing the pills in that container. Releasing the switch 35 has already reset the clock to actuate the signals 32 and 33 for the next timed sequence.

Pushing the lever arm 35 mounted through slot 36 pushes the container 40 having a plurality of pills 41 through the opening 14 when the magazine section 38 is in alignment with the opening 14.

Figure 5:
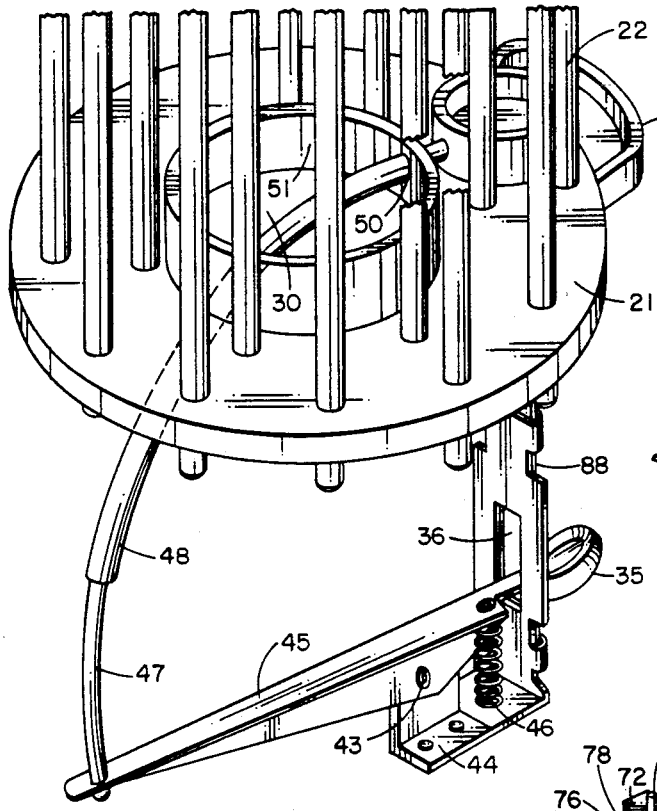
FIG. 5 is a perspective view of the pill dispensing magazine and pill container dispenser portion of the pill dispenser of FIGS. 1-4.
Figure 9:
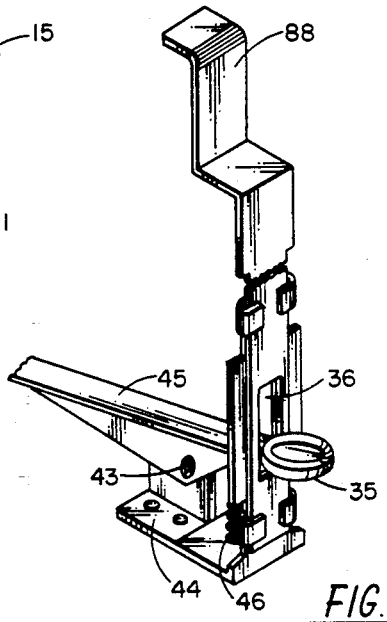
FIG. 9 is a perspective view of the timer reset mechanism.
Figure 8:
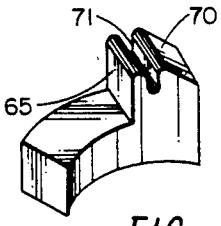
FIG. 8 is a perspective view of the arm support of FIG. 6.

As seen more clearly in FIG. 5, the lever arm 35 is pinned with a pin 43 to a support bracket 44 and has a lever extension 45. A coil spring 46 is mounted between the bracket 44 and the lever arm 35 so that pushing the handle portion of the lever arm 35 pushes against the spring 46 and rotates the lever arm 45 portion on the fulcrum 43 to push a flexible rod 47 sliding in a flexible sleeve 48. The sleeve 48 is attached at 50 to the inner ring 51 of the magazine 18 and has the pushing portion 52 which pushes against the next aligned pill container 40 to push it onto the pill supporting table 15. The spring 46 then returns the flexible rod 47. Flexible rod 47 has a coiled wrapped wire which allows it to flex and rotate within the sleeve 48 as the magazine 18 is rotated.

Figure 6:
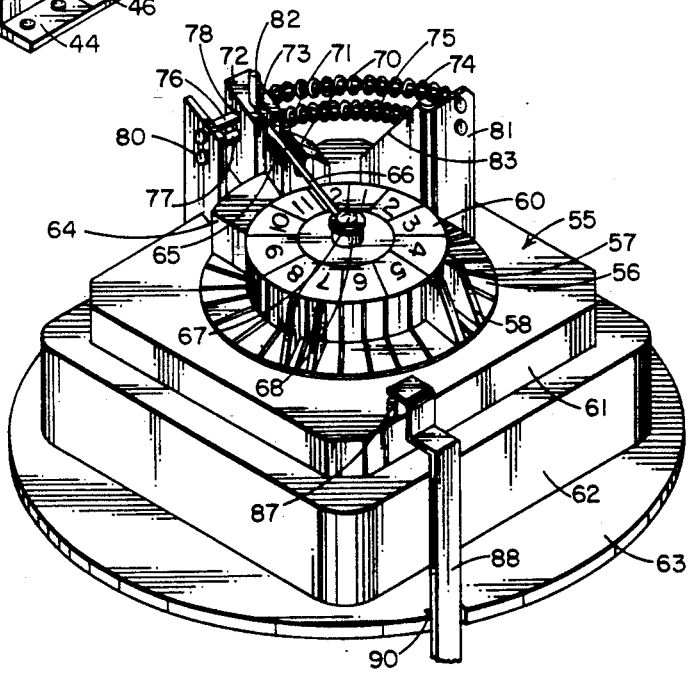
FIG. 6 is a perspective view of a motorized embodiment for shifting the pill dispenser magazine.
Figure 7:
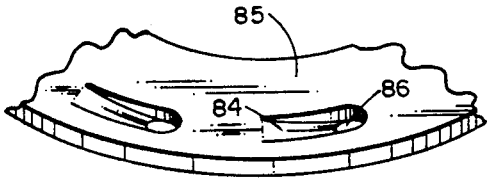
FIG. 7 is a partial perspective view of the bottom of the pill dispensing magazine for use in the embodiment of FIG. 6.

Referring specifically to FIGS. 6 and 7, a motorized embodiment of the pill dispenser of FIGS. 1-5 and has the same exterior as shown in FIG. 1 and uses all of the components shown in FIGS. 1-5 except for the slot 37 and manually moved knobs 24 of FIG. 3 which may nevertheless also be in the motorized version. As seen in FIG. 6, a conventional electric timer 55, such as timers used in timing lights, hot water heaters, and sprinkler systems, has a rotating face 56 with a plurality of slots 57 having timing keys 58 which are pushed into the slots to determine the actuation of the conventional timer at any period during a 24 hour cycle and which may be set based on the timer face 60. The timing members 58 may be used to actuate the visual/audio alarms 32 and 33 on a timed cycle. The timing mechanism 55 had been mounted in a base 61 supported on a base 62 which in turn is supported on a bottom plate 63 inside the housing 11. The timer has been modified by adding an arcuate support 64 which rotates with the timer plate 56 and which adds an arm supporting portion 65 attached thereto. An arm 66 is loosely mounted to the center 67 of the timer 55 such that it can be freely rotated or raised up and down on a hinged sleeve 68. The arm 66 is captured by a camming surface 70 on the member 65 and drops into and is supported in a slot 71 so that the arm 66 is turned with the timing mechanism as the timing face rotates, rotating the support 64 and arm support 65. The arm 66 is, however, captured at one end in a slidable arm support member 72 within a slot 73. As the timer 55 rotates and rotates the member 65, the arm 66 is pulled along to move the arm capturing member 72 against a coiled spring 74 and 75 on a pair of arcuate arms 76 and 77. As the timer rotates, it continues to turn the arm 66 and the member 72 having a pair of bores 78 therethrough riding on the arms 76 and 77 against the coil springs. The arms 76 and 77 are held to frame members 80 and 81 which are mounted to the base 61 and 62. The arm 66 is mounted under a vertically extending dog 82 also positioned in the slot 73. As the clock turns, the arm 66 is rotated by being caught in the slot 71 of the members 65 until the arm 66 reaches a camming surface 83 which gradually pushes the arm 66 hinged on a member 68 to raise the arm above the slot 71 and to push the vertical dog 82 in a raised position as the arm 66 slides on the camming surface 83. The dog 82 slides into the ramped cutouts 84 in a base 85 of the magazine 18 as shown (upside down) in FIG. 7. The vertical dog 82 engages the ramp 84 until it reaches the stop 86 where it then rotates the magazine 18 by pushing the magazine as the arm 66 is pulled around in the slot 71 of the rotating member 65. As the arm 66 comes to the end of the camming surface 83 it has been raised all the way out of the slot 71 so that the rotating member 61 or 65 attached to the rotating timer pass under the arm 66 and continue their rotation without the arm 66 which drops back down into the slot 73 of the shifting member 72 allowing the dog 82 to drop back in the slot 73 outside of the slot 71 so that the springs 74 and 75 will push the member 72 back on the arcuate arms 76 and 77 and thus returning the arm 66 back to a start position against the frame plate 80. The timer continues around a complete cycle until the members 61 and 65 allow the camming surface 70 to again lift the arm 66 into the slot 71 of the member 65 to thereby start the rotation of the member 72 on the arms 75 and 76.

As shown in FIG. 6, a 12-hour timer is illustrated but can be a 4-hour timer or the 12-hour timer may have additional magazine rotating mechanisms to provide shifting of the magazine on any timed sequence desired. A switch member 87 is actuated from outside the housing by a switch lever 88 which extends over the member 87 and through a slot 90 where it can be used to pull down the switch 87 to turn the timer on or off as desired.

It should be clear at this time that a simplified pill dispenser has been provided which advantageously has signals built in to alert an individual when it is time to take the next pills and which aligns the pills to be taken into position and also assures the patient that the appropriate days pills are being dispensed so that an elderly person or any one taking medicine that might affect the memory is safeguarded against taking the wrong pills or forgetting to take the pills in any particular timed sequence. It should also be clear that the dosage in the pill containers can be varied when the pill containers are loaded into the dispenser so that the dosage can be increased or decreased from day to day or from week to week as the medicines are dispensed. The magazine is conveniently loaded by loading all of the pill containers which would typically show one for each work day from Monday through Sunday along with one spare position if desired and may have six timed sequences for dispensing pills during one 24-hour period. An alarm is set from beneath the base to activate the signals several times a day every day of the week and the pill containers 17 can be reloaded once each week. Thus, the pill dispenser prevents mixing up the dosages or forgetting to take the pills as well as preventing a patient from taking the pills twice in a dispenser mechanism which is simple and inexpensive to manufacture with an existing timer mechanism. However, the present invention should not be construed as limited to the forms shown which should be considered illustrated rather than restrictive.

I claim:

1. A dispenser for dispensing predetermined pills in sequential order comprising:

a housing having a base and a cylindrical cover removably mounted on said base and said housing having a pill container dispenser opening therein;

a plurality of pill containers;

a pill container magazine rotatably mounted inside said housing cover and having a plurality of magazine sections thereon for holding a plurality of vertical stacks of said pill containers in stacked arrays;

magazine rotating means for rotating said magazine on a timed sequence between pill dispensing positions, said magazine rotating means including a timer mechanism operatively coupled to said magazine to rotate said magazine between dispensing positions, said timer mechanism having an arm movably attached thereto and having a motorized rotating face thereon and an arm catching means mounted to said rotating face for catching and releasing said arm as said arm catching means moves with said timer face, said magazine rotating means also having a magazine shifting member connected to said arm to engage and shift said magazine responsive to the movement of said arm;

signal means mounted in said base and actuated on a timed sequence to signal a time for taking the pills in one said pill container; and pill container dispensing means located inside said housing for dispensing a pill container from said magazine through said housing dispensing opening, whereby the pill dispenser signals a patient and allows the shifting of the pill container magazine to a position for a pill container to be dispensed to thereby assist a patient in taking the correct dosage in the correct time sequence.

2. A dispenser for dispensing predetermined pills in sequential order in accordance with claim 1 in which said magazine rotating means timer mechanism arm catching means includes a camming surface and an arm capturing slot thereon.

3. A dispenser for dispensing predetermined pills in sequential order in accordance with claim 2 in which said magazine rotating means magazine shifting member is connected to said arm in a sliding member having a slot therein and riding on a track supported by a framework and said framework includes a camming surface for lifting said arm in a predetermined sequence to control the movement of said magazine with said timer mechanism.

4. A dispenser for dispensing predetermined pills in sequential order in accordance with claim 2 in which said magazine has a bottom plate having a plurality of catch surfaces formed therein and positioned to be captured by said magazine shifting member to thereby move said magazine with said timer mechanism.

5. A dispenser for dispensing predetermined pills in sequential order in accordance with claim 1 in which said signal means includes a light source.

6. A dispenser for dispensing predetermined pills in sequential order in accordance with claim 5 in which said signal means includes a sound transducer.

7. A dispenser for dispensing predetermined pills in sequential order in accordance with claim 6 in which said signal means is coupled to said timer mechanism to actuate said light source and said sound transducer.

8. A dispenser for dispensing predetermined pills in sequential order in accordance with claim 7 in which housing cover is transparent and said magazine has a top plate which has indicia thereon visible through said transparent housing cover.

9. A dispenser for dispensing predetermined pills in sequential order in accordance with claim 1 having a pill container dispensing mechanism which includes a lever arm pinned to move on a bracket attached to said housing base.

10. A dispenser for dispensing predetermined pills in sequential order in accordance with claim 9 in which said pill container dispensing mechanism includes a sliding flexible arm attached at one end to said lever arm and sliding in a flexible sleeve whereby shifting said lever arm moves said sliding flexible arm in said flexible sleeve and pushes against a pill container to dispense said container.

11. A dispenser for dispensing predetermined pills in sequential order in accordance with claim 10 in which said pill container dispensing mechanism lever arm has a spring connected thereto to return said lever arm and sliding flexible arm to a rest position.

12. A dispenser for dispensing predetermined pills in sequential order in accordance with claim 11 in which said pill container dispensing mechanism sliding flexible arm sleeve is connected at one end to said dispensing magazine.

* * * * *